US005125377A

United States Patent [19]

Mezheritsky

[11] Patent Number: 5,125,377

[45] Date of Patent: Jun. 30, 1992

[54] APPARATUS TO CLEAN AN ENGINE WITHOUT DISMANTLING THE ENGINE

[76] Inventor: Anatoly D. Mezheritsky, 8460 Ash Street, Vancouver, Canada, V6P 3M2

[21] Appl. No.: 796,991

[22] Filed: Nov. 25, 1991

[51] Int. Cl.[5] ..... F02B 77/00

[52] U.S. Cl. ..... 123/198 A; 123/25 B; 123/25 H

[58] Field of Search ..... 123/25 B, 25 H, 25 A, 123/25 D, 25 G, 198 A

[56] References Cited

U.S. PATENT DOCUMENTS 3,779,213 12/1973 Knudsen ..... 123/198 A 3,961,482 6/1976 Janaux ..... 123/198 A

*Primary Examiner*—Noah P. Kamen

[57] ABSTRACT

An internal combustion engine having pistons, cylinders, an air cooler, an air manifold and a turbocharger with a compressor. There is a tank to contain hot water under pressure. The pressure in the tank and the water temperature can be controlled. At least one injector allows heated water to be injected into the turbocharger compressor. A further injector allows water to be injected into the air cooler and a plurality of yet further injectors allow water to be injected into the air manifold. Conduits supply water from the tank to the injectors. Control of flow in the conduits is by valves. The invention permits the cleaning of an internal combustion engine without dismantling the engine or the turbocharger.

16 Claims, 4 Drawing Sheets

APPARATUS TO CLEAN AN ENGINE WITHOUT DISMANTLING THE ENGINE

FIELD OF THE INVENTION

This invention relates to an apparatus and method for removing deposits from an induction system of an internal combustion engine.

DESCRIPTION OF THE PRIOR ART

During the normal operation of internal combustion engines having forced induction there is a gradual deterioration in performance. Forced induction is usually achieved with a turbocharger, which is a pump to force air into the engine. Some turbocharger force the fuel-/air mixture, but usually only the air is forced. A basic turbocharger comprises a turbine, driven by exhaust gas on a common shaft with a compressor that includes a compressor wheel having blades. The compressor wheel is rotated rapidly by the rotation of the turbine and the blades pump the air. One of the main reasons for the deterioration in performance is deposits on the compressor side of the turbocharger and on the air cooler, air manifold, scavenging ports or exhaust and intake valves.

It is therefore necessary to remove these deposits. At the moment the most common method of removing deposits is to scrape the deposits manually during scheduled engine overhauls. These overhauls are usually carried out after two to five years of operation. This method is expensive. It requires that the engine and turbocharger be out of service and is not, therefore, used frequently. Thus for approximately 85 to 95% of operational time engines are working with fouled surfaces of the turbocharger, air coolers, air intake manifolds, scavenging ports or exhaust and intake valves. This fouling significantly increases exhaust temperature and fuel consumption and decreases air pressure in the forced induction system.

The air fed into an internal combustion engine contains very fine particles of dust, moisture, oil and other substances. Various filters are, of course, used to clean the air but even the best filters cannot completely prevent particles from entering the engine. In forced induction systems these particles enter the compressor of the turbocharger. Fouling of the engine and of the induction system is inevitable. Intensity of fouling depends on many factors such as the catching ability of the compressor blades, the quantity of dust and oil in the air and the number of operational hours. It can be shown that the most intensive growth of the deposit layer on the engine components takes place during the first fifty to two hundred hours of operation, depending on the engine type and the condition of the operation. In the next one thousand hours the deposit layer grows slowly and, after approximately fifteen hundred to two thousand hours, it stabilizes.

The deposits reduce the passage for air flow, the surfaces becomes rough and the volume of air supplied by the turbocharger into the engine cylinders decreases. As a result, the engine efficiency decreases. The exhaust temperature and fuel consumption increase and the charged air pressure, and thus available engine power, decrease.

A further disadvantage is that fouling of the turbocharger can cause surge; the deposits reduce the safe margin against the surge line.

To solve these problems, some diesel engine manufacturers have developed systems for washing turbochargers without dismantling. For example, a system is known for washing turbochargers in which approximately one to two liters of cold water is put into a tank and injected into the compressor through tubing of about 8 to 10 mm diameter. The injection is carried out by using the pressure of super charged air at 10 to 18 pounds per square inch. The washing procedure takes place every 24 to 48 hours during normal operation of the engine, without reduction of the engine's revolutions.

This system has not achieved complete success. The deposits are mainly removed from the compressor wheel. The compressor's diffuser, where deposits settle the most, is hardly affected by this washing system. As a result, the system is not particularly effective. A further disadvantage is that the deposits removed from the compressor wheel pass through the air cooler, through the air intake manifold and across the intake valves and the scavenging ports. Unfortunately, because of the way in which the water is introduced, the particles moved from the compressor settle on these subsequent surfaces. As a result, the improvements achieved using the above system have been disappointing.

A further approach is to use solvents other than water. This method is more effective than the use of water but constant use of these solvents has an undesirable effect on the engine oil and also results in corrosion of the pistons, cylinders and other internal parts of the engine. As a result, the use of solvents other than water is not now used.

There is, therefore, a need for a system able to carry out washing of an engine and turbocharger without dismantling and without simply transferring deposits from one part of the engine to another.

SUMMARY OF THE INVENTION

Accordingly, and in a first aspect, the present invention is an internal combustion engine having pistons and cylinders, an air cooler, air manifold and a turbocharger with a compressor. The internal combustion engine includes a washing system that comprises a tank to contain hot water, means to apply pressure to the tank, means to control the pressure in the tank, at least one first injector to allow heated water to be injected into the turbocharger compressor, at least one second injector to allow water to be injected into the air cooler, a plurality of third injectors to allow water to be injected into the air manifold, conduits to supply water from said tank to said first, second and third injectors, and valve means to control water flow in said conduits.

The present invention resulted from a thorough analysis of the problem of deposition on forced induction components. It was found that the deposits on the compressor of the turbocharger, the air cooler, the air intake manifold and the intake valves are produced by polymerization of lubricating oil, dust, moisture and other substances. First it was that the use of hot water is desirable. Furthermore, there is an optimum size of water droplets. In general, the size of water droplets depends on the engine power, the type and size of the turbocharger, the size of the air cooler and the diameter and length of the air intake manifold. In a preferred embodiment the optimum size of water droplets for washing the compressor is obtained by injecting water at 25 to 35 pounds per square inch through an injector with an opening of about 0.9 to 1.5 mm. For the air cooler, the pressure is the same but the jet that directs water against the air cooler is of a size 1.5 to 2.5 mm. For the air intake manifold, again the pressure is as indicated above but the injector has a size in the range 1.5 to 3 mm.

It is further found that the injector for the compressor should be pointed at the base of the blades of the compressor and should be located about 4 to 10 mm off the center line of the rotor of the turbocharger. The most effective distance between the nozzle tip and the compressor wheel is about 3 to 6 mm.

The optimum quantity of water required for washing should be determined based on the proportion of 0.04 kg per second of water for 1 kg per second of air used by the engine. Alternatively, 0.6 grams of water for each square meter of surface to be cleaned may be used.

BRIEF DESCRIPTION OF THE DRAWINGS

The invention is illustrated, merely by way of example, in the drawings in which.

DESCRIPTION OF THE PREFERRED EMBODIMENTS

Figure 4:
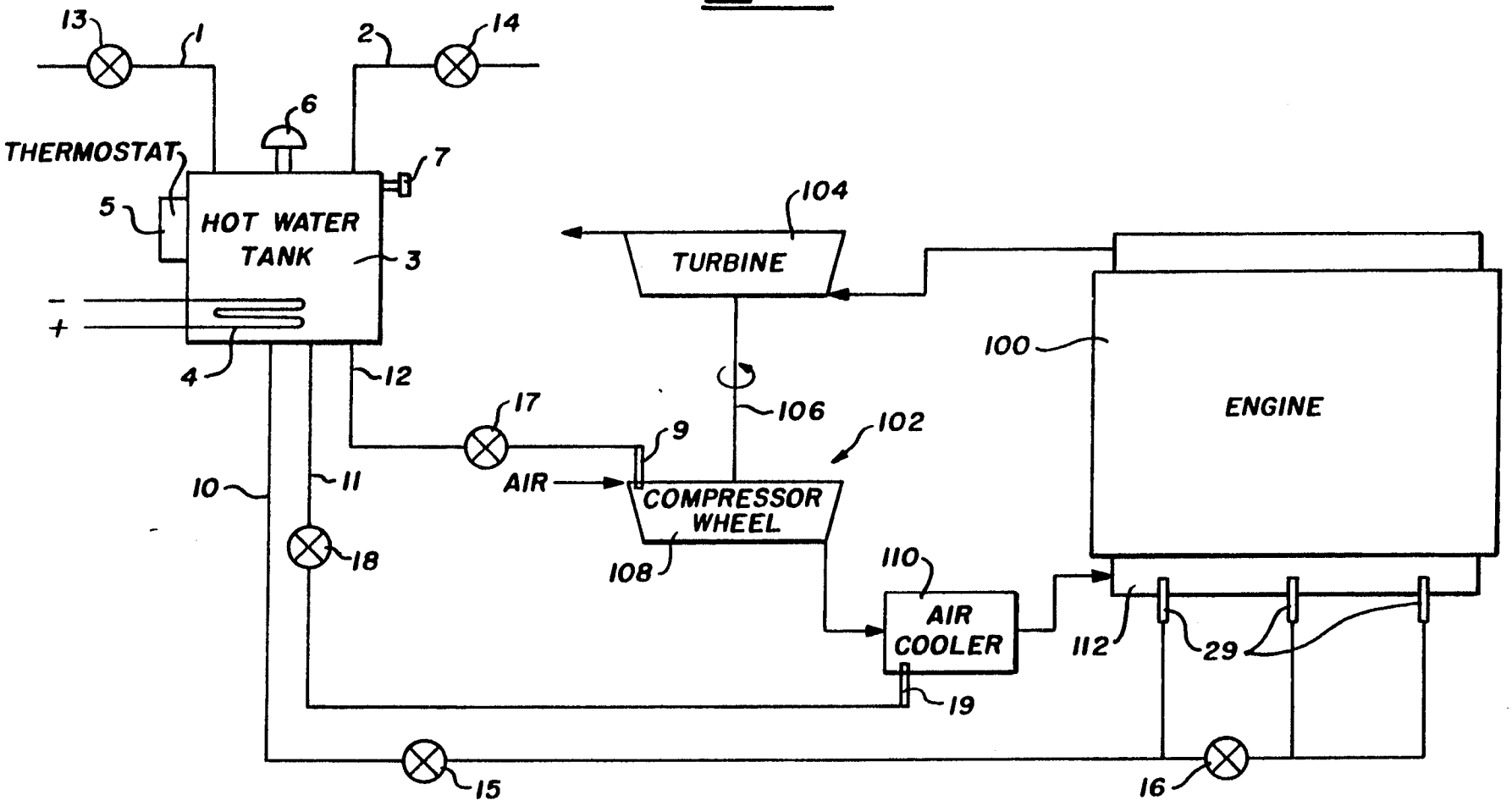
FIG. 4 is a diagrammatic view of an engine according to the present invention.

Referring first to FIG. 4, a conventional turbo charged diesel engine is shown. The engine is entirely conventional. It includes pistons and cylinders (not shown), a cylinder head 100, a turbocharger 102 having a turbine 104, a shaft 106 and a compressor wheel 108 that is part of the compressor. The compressor is not shown in FIG. 4 but is shown partially in FIG. 2. The engine includes an air cooler 110 and air manifold 112.

According to the invention the engine is modified to include a tank 3 to contain hot water. There are means to apply pressure to the tank in the form of a supply of compressed air of 25 to 35 pounds per square inch through conduit 2. Conduit 2 is controlled by a valve 14 which thus provides a means to control the pressure in the tank 3. The tank 3 includes means to heat the water in the form of a simple heating coil 4. There is a thermostat 5 to control the water temperature. In a preferred embodiment the thermostat 5 controls the temperature of the water to about 95° to 96° C.

There is a water supply conduit 1 to the tank 3 controlled by valve 13. The tank also has an air vent 7 and a pressure relief valve 6. The pressure in the tank 3 should be controlled so that the pressure does not exceed double the working pressure of 25 to 35 pounds per square inch.

There are injectors 9 to allow heated water to be injected into the compressor. A conduit 12, controlled by valve 17, extends from the tank to the injectors 9. Hot water is also supplied from the tank 3 by conduit 11 to air cooler injectors 19. Conduit 11 is controlled by valve 18.

Finally, the air manifold 112 has injectors 29 to receive hot water from the conduit 10. Flow in conduit 10 is controlled by valves 15 and 16.

Figure 2:
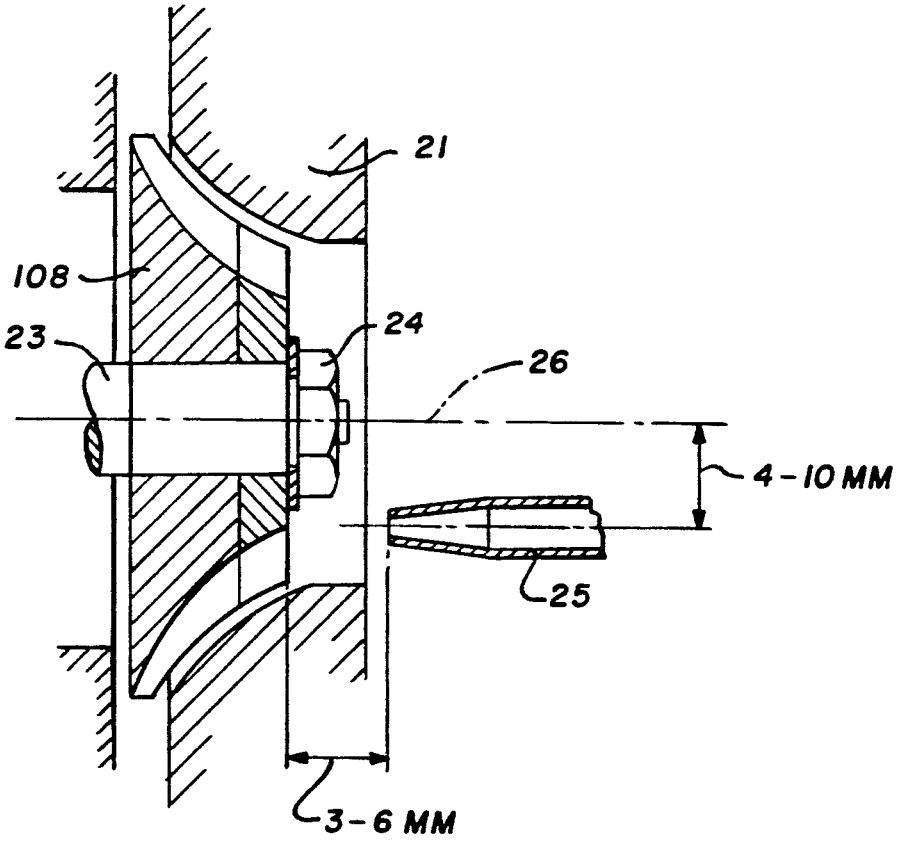
FIG. 2 illustrates the injector installation for a turbocharger's compressor.

As shown particularly in FIG. 2, the compressor comprises a casing 21 with compressor wheel 108 mounted on a shaft 23 and located by nut 24. There is an injector 25 that directs water against the base of the compressor wheel 22. The water should be directed at about 4 to 10 mm from the center line 26 of the shaft 23 and its tip should be approximately 3 to 6 mm from the adjacent surface of the wheel 108 for best results.

The system works as follows. The water tank 3 is filled with cold fresh water and heated by means of the heater 4. The thermostat 5 controls the heater 4 and automatically switches off the heater 4 when the temperatures reaches about 95° to 96° C. Valve 14 on the compressed air line 2 is opened to apply a pressure of 25 to 35 pounds per square inch to tank 3. Valve 17 in conduit 12 is opened and water under the above pressure is injected through the injector 9, which has a diameter of 0.9 to 1.5 mm, into the compressor. The same procedure is repeated sequentially to inject water into the air cooler 110 and then separately into the air intake manifold 112 by controlling valves 15, 16 and 18 as needed.

This arrangement of washing the deposits ensures that deposits removed from one component do not settle on another. In particular deposits removed from the compressor do not settle on the air cooler or on the walls of the air intake manifold. The procedure takes about 5 to 15 minutes, depending on the engine power, the number of turbocharger and the like.

Figure 1:
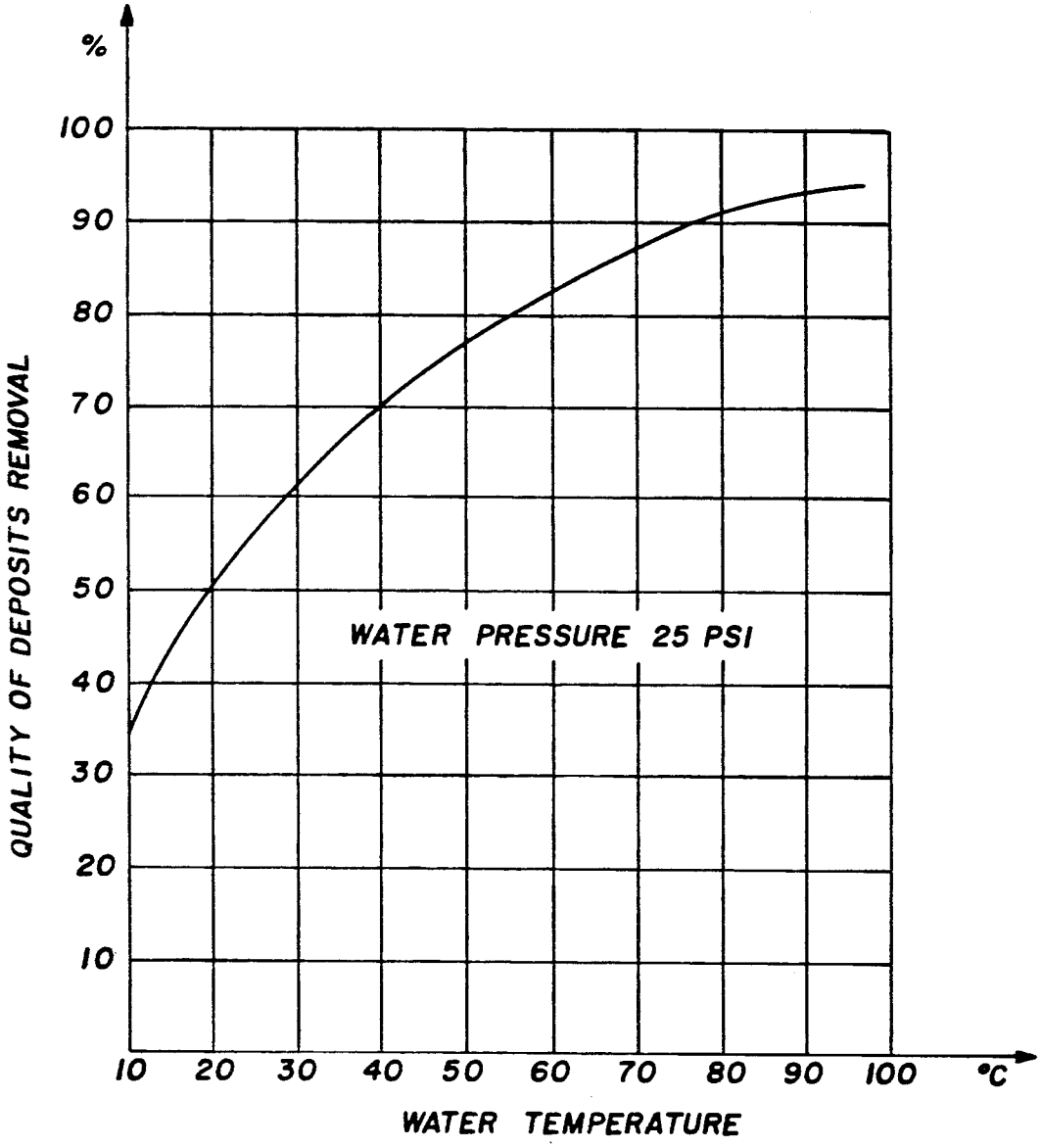
FIG. 1 is a graph relating deposit removal to water temperature.

FIG. 1 illustrates that the water temperature should be about 96° C. At that temperature approximately 95% of 15 the deposits are removed with water pressure at 25 pounds per square inch.

Figure 3:
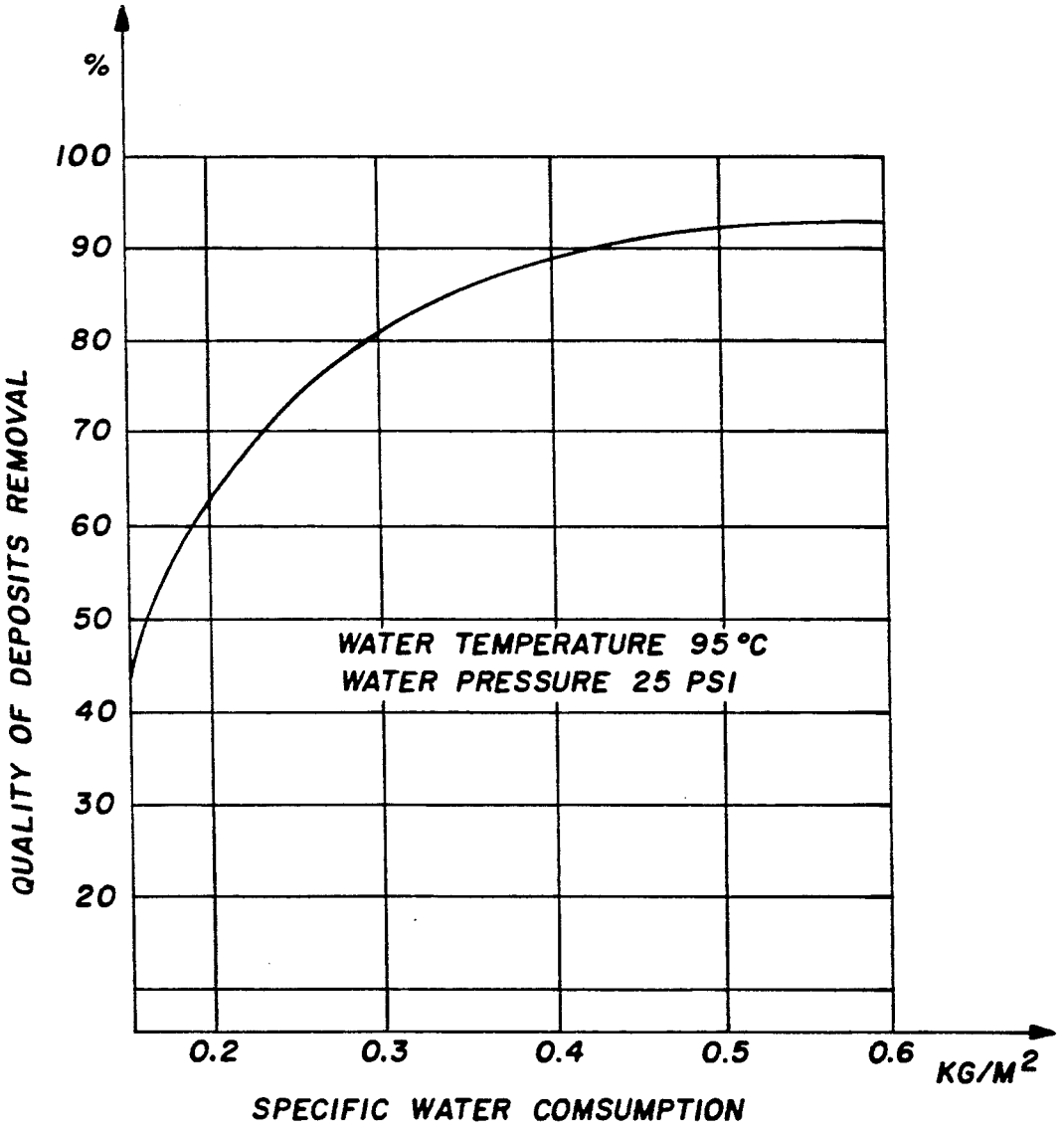
FIG. 3 is a graph relating the amount of water to effectiveness of deposit removal.

FIG. 3 illustrates the amount of water that should be applied. With a specific water consumption of 0.6 kg per meter square of surface area to be cleaned there is a removal of deposits greater than 93%.

I claim:

1. In an internal combustion engine having pistons and cylinders, an air cooler, an air manifold and a turbocharger with a compressor, the improvement that comprises:

a tank to contain hot water;

means to apply pressure to the tank;

means to control the pressure in the tank;

at least one first injector to allow hot water to be injected into the compressor;

at least one second injector to allow hot water to be injected into the air cooler;

a plurality of third injectors to allow hot water to be injected into the air manifold;

conduits to supply hot water from said tank to said first, second and third injectors; and valve means to control water flow in said conduits.

2. An engine as claimed in claim 1 in which the tank includes means to heat said water and a thermostat to control said water temperature.

3. An engine as claimed in claim 2 in which the thermostat controls the temperature of the water to about 95° to 96° C.

4. An engine as claimed in claim 1 including a water supply conduit to said tank;

a valve in said conduit to control the water supply.

5. An engine as claimed in claim 1 in which the means to apply pressure to the tank is compressed air;

a conduit to supply said air to said tank from a source; and a valve in said conduit to control supply.

6. An engine as claimed in claim 5 in which a pressure relief valve operates to control air pressure in the tank so that pressure does not exceed double working pressure.

7. An engine as claimed in claim 1 in which said at least one first injector has an opening with a size in the range 0.9 to 1.5 mm.

8. An engine as claimed in claim 1 in which said turbocharger includes a compressor wheel with blades, said injector directing water at a point close to roots of said blades.

9. An engine as claimed in claim 8 in which the water is injected along a line about 4 to 10 mm from the center line of the rotor.

10. An engine as claimed in claim 9 in which the jet outlet is located about 3 to 6 mm from the compressor blades.

11. An engine as claimed in claim 1 in which the second injector has an opening with a size in the range 1.5 to 2.5 mm.

12. An engine as claimed in claim 1 in which the third injectors each have an opening with a size in the range 1.5 to 3 mm.

13. A method of cleaning a forced induction internal combustion engine, the engine having a turbocharger that includes a compressor, an air cooler and an air manifold, the method comprising injecting hot water separately into said compressor, air cooler and air manifold.

14. A method as claimed in claim 13 in which the water temperature is in the range 95° to 96° C. and the pressure of injection is about 25 to 35 pounds per square inch.

15. A method as claimed in claim 13 in which the hot water is injected at the rate of about 0.04 kg per second of water per 1 kg per second of air used by the engine.

16. A method as claimed in claim 13 in which the hot water is injected at the rate of about 0.6 grams per square meter of surface to be cleaned.

* * * * *